US005117992A

United States Patent [19]

Simkus, Jr. et al.

[11] Patent Number: 5,117,992

[45] Date of Patent: Jun. 2, 1992

[54] SYSTEM FOR LEARNING CONTROL COMMANDS TO ROBOTICALLY MOVE A LOAD, ESPECIALLY SUITABLE FOR USE IN CRANES TO REDUCE LOAD SWAY

[75] Inventors: Anthony P. Simkus, Jr.; Chester D. Rudolf, III, both of Virginia Beach, Va.

[73] Assignee: Virginia International Terminals, Inc., Norfolk, Va.

[21] Appl. No.: 646,932

[22] Filed: Jan. 28, 1991

[51] Int. Cl.[5] ..... B66C 1/42

[52] U.S. Cl. ..... 212/147; 901/4; 414/141.3

[58] Field of Search ..... 414/5, 137.1, 141.3, 414/141.4, 139.4, 143.2; 901/4; 212/146-147, 190, 205, 207, 210, 214, 225, 257

[56] References Cited

U.S. PATENT DOCUMENTS

| | | | |
|---|---|---|---|
| 2,988,237 | 6/1961 | Devol . | |
| 3,306,471 | 2/1967 | Devol | 414/1 R |
| 3,517,830 | 6/1970 | Virkkala . | |
| 3,648,143 | 3/1972 | Harper et al. | 901/4 |
| 3,881,608 | 5/1975 | Hupkes | 414/141.3 |
| 4,037,742 | 7/1977 | Gustafsson . | |
| 4,260,941 | 4/1981 | Engelberger et al. | 901/4 |
| 4,263,538 | 4/1981 | Richardi | 901/4 |
| 4,329,110 | 5/1982 | Schmid | 901/4 |
| 4,504,918 | 3/1985 | Axmann . | |
| 4,516,117 | 5/1985 | Couture et al. . | |
| 4,717,029 | 1/1988 | Yasunobu et al. . | |
| 4,753,357 | 6/1988 | Miyoshi et al. | 414/141.7 |
| 4,756,432 | 7/1988 | Kawashima et al. . | |
| 4,815,614 | 3/1989 | Putkonen et al. . | |
| 4,837,734 | 6/1989 | Ichikawa et al. | 901/4 |
| 4,905,848 | 3/1990 | Skjonberg . | |

FOREIGN PATENT DOCUMENTS

| | | | |
|---|---|---|---|
| 3727329 | 3/1989 | Fed. Rep. of Germany | 212/147 |
| 17256 | 2/1979 | Japan | 414/141.3 |
| 56396 | 2/1990 | Japan | 212/147 |

*Primary Examiner*—Jesûs D. Sotelo
*Assistant Examiner*—Stephen P. Avila
*Attorney, Agent, or Firm*—Mason, Fenwick & Lawrence

[57] ABSTRACT

The electronic anti-sway system involves two modes, a "LEARN mode" and an "AUTO mode". In the LEARN mode, an experienced operator operates the crane manually while his specific control movements are observed by the inventive system. The movements are stored, along with such parameters as load position as a function of time, and the weight of the load. Preferably, for loads and movement paths which are substantially identical, only the most efficient path produced by the experienced human operator is recorded permanently, less efficient paths being discarded. A library of preferred paths is thus accumulated, preferably with one preferred path for each type of load and source/destination. Thereafter, in the "AUTO mode", an operator may entrust movement of the load to the present system, which causes the load to efficiently and safely traverse an optimum path (with minimum sway) in a minimum period of time. Preferably, various safeguards are provided by the system. For example, the crane is preferably manually controlled during the very beginning and end portions of the load's movement. Further, if the path traversed by a load in the "AUTO" mode deviates significantly from the projected paths recorded in the library, the system automatically stops the load's movement and surrenders control to the human operator.

17 Claims, 5 Drawing Sheets

SYSTEM FOR LEARNING CONTROL COMMANDS TO ROBOTICALLY MOVE A LOAD, ESPECIALLY SUITABLE FOR USE IN CRANES TO REDUCE LOAD SWAY

BACKGROUND OF THE INVENTION

1. Field of the Invention

The present invention relates to systems and methods for automatically controlling cranes in moving loads from a source location to a destination location. More specifically, the invention relates to systems and methods of automatically controlling cranes to move such loads according to paths learned from experienced human operators.

2. Related Art

Systems and methods for movement of loads by cranes are known in the art. However, in cranes utilizing wire ropes to suspend a load, it has long been a problem that the load tends to sway near the end of the load's path. This sway requires the crane operator to wait before lowering the load to its final destination, or to incorporate complicated and coordinated control motions to reduce the amount of sway. This waiting period proves costly when repeated over a number of loads.

Typically, crane operators have reduced sway of the load through complicated and coordinated movement of trolley and hoist control sticks. Over time, and with the proper training and experience, control stick movement may become a subconscious effort. However, less experienced operators find it more difficult to efficiently, quickly and safely move the load with less sway. Further, even experienced operators find such movement difficult at the end of extended periods of crane operation, due to growing fatigue. Moreover, such problems as fog or poor depth perception can cause operation of the crane to be slow, inefficient, or unsafe.

It is therefore desirable to provide a system which allows all crane operators to quickly, safely and efficiently move a load from a source location to a destination location.

Many known systems include physical mechanisms for absorbing the oscillatory energy of the load, thereby reducing the magnitude and duration of the load's sway. However, this approach involves reduction of sway induced by the operator's control of the crane, and not with preventing sway in the first place.

Various other systems are known for improving certain aspects of the unloading process. With the advent of reliable, affordable and physically small digital electronic computers, monitoring and/or control of the crane during the movement of loads has become possible.

For example, U.S. Pat. No. 3,517,830 (Virkkala) discloses compensation for operator-induced changes in acceleration. U.S. Pat. No. 4,037,742 (Gustafsson) dislcosed program-controlled loading. U.S. Pat. No. 4,504,918 (Axmann) discloses collision avoidance during a ship loading process by automatically switching off and stopping the crane. U.S. Pat. No. 4,516,117 (Couture et al.) discloses a sensing of a position of a load, and activating an alarm when a potentially dangerous detected physical location is encountered. U.S. Pat. Nos. 4,717,029 (Yasunobu et al.) and U.S. Pat. No. 4,756,432 (Kawashima et al.) disclose use of a velocity profile in an unloading process. U.S. Pat. No. 4,815,614 (Putkonen et al.) discloses definition of a maximum speed based on a measured weight of a load. U.S. Pat. No. 4,905,848 (Skjonberg) discloses use of a computer in which plural hoists are used on a single load. U.S. Pat. No. 2,988,237 (Devol) discloses an early system for programmed movement of articles. All documents cited in this specification are incorporated by reference herein as if reproduced in full below.

Man of the above systems involve complex theoretical considerations which are not readily adapted to a given load movement scenario. For example, a system for moving articles from a palette to a conveyer belt in a factory is not readily adapted to unloading containers from a ship's hold to a pier.

Moreover, many known systems generally do not involve an optimum allocation of control between a human operator and the computer. There are times when operator intervention should preferably be excluded, times when operator intervention is demanded, and still other times when it is preferably left to the operator whether to manually or automatically control the movement of the load.

Further, many known systems involve concentration on a small part of the load movement process, not on the overall "bottom line" efficiency of each unloading process and a series of many unloading processes. From an economic point of view, the long-term cost-effectiveness of a crane control system is determined by the frequency of load operations, with reduction of load sway and personal safety being among the considerations. This frequency is related to optimized allocation of automated and manual control of the crane during the load movement process.

Finally, the disclosed systems do not adequately use the expertise which is developed in human operators over long periods of time and in a variety of load movement scenarios. Nor do the known systems repeatably apply this level of learned expertise to a variety of load types and load movement paths.

The present invention provides an economic and efficient solution to these shortcomings of known systems.

SUMMARY OF THE INVENTION

The present invention provides a system and method for moving a load from a source location to a destination location quickly, efficiently, safely, and with a minimum of sway.

The system involves two modes, a "LEARN mode" and an "AUTO mode". In the LEARN mode, an experienced operator operates the crane manually while his specific control movements are observed by the inventive system. The movements are stored, along with such parameters as load position as a function of time, and the weight of the load. Preferably, for loads and movement paths which are substantially identical, only the most efficient path produced by the experienced human operator is recorded permanently, less efficient paths being discarded. A library of preferred paths is thus accumulated, preferably with one preferred path for each type of load and source/destination.

Thereafter, in the AUTO mode, an operator may entrust movement of the load to the present system, which causes the load to efficiently and safely traverse an optimum path (with minimum sway) in a minimum period of time.

Preferably, various safeguards are provided by the system. For example, the crane is preferably manually controlled during the very beginning and end portions of the load's movement, corresponding to the precise positioning of the load on the ship or dock. Further, if the path traversed by a load in the "AUTO" mode deviates significantly from the projected path recorded in the library, the system automatically stops the load's movement and surrenders control to the human operator.

Other objects, features, and advantages of the present invention will become apparent to those skilled in the art upon a reading of the following Detailed Description in conjunction with the accompanying drawing figures.

DETAILED DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
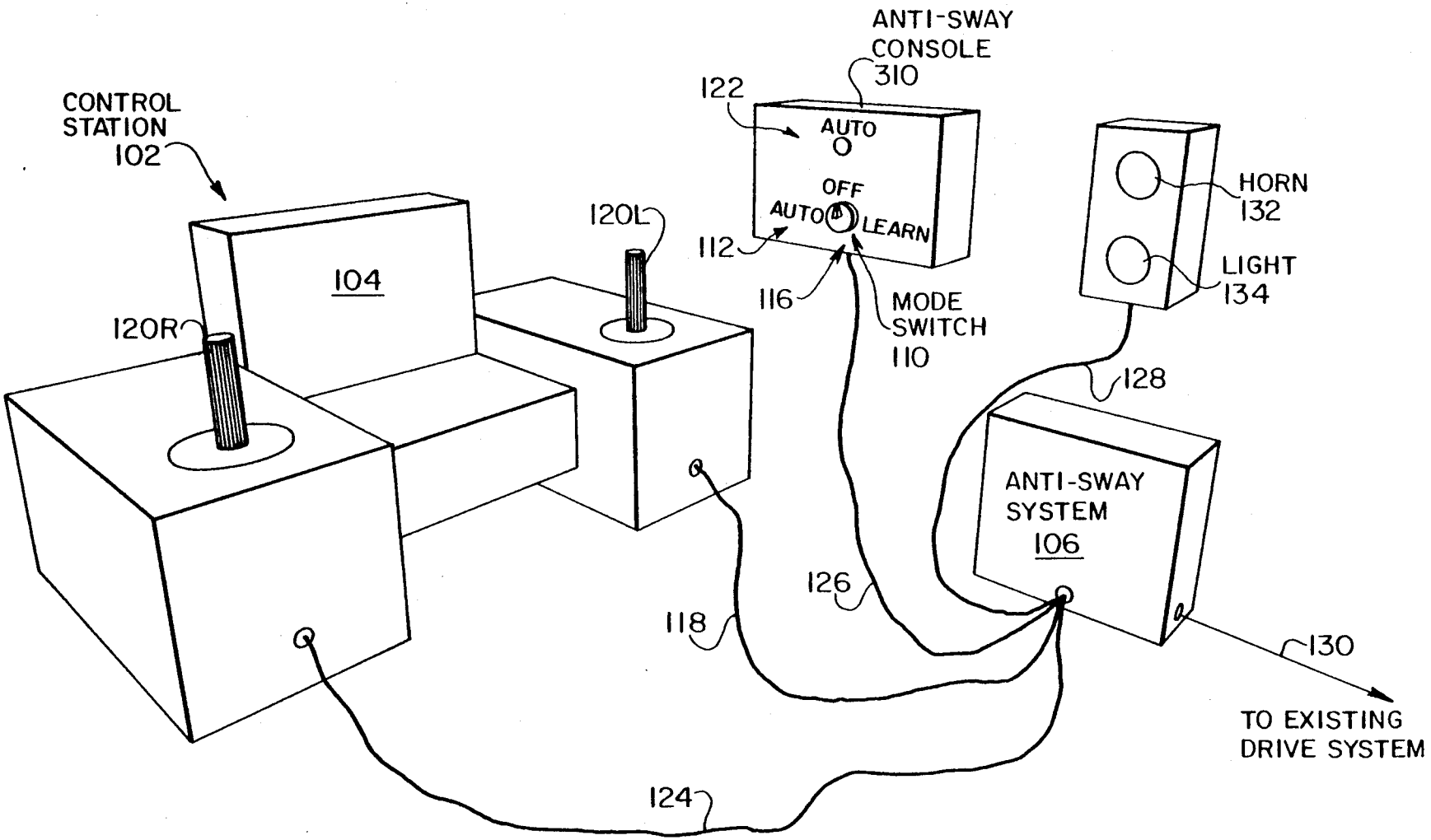
FIG. 1 is a perspective schematic drawing of a crane control system using an anti-sway system according to a preferred embodiment of the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

In the present specification, special reference will be made to systems and methods for unloading containers from the hold of a ship to a pier. Unloading containers from a ship to a pier constitutes but one example of moving a load from a source location to a destination location. The invention is applicable to virtually any operation where a movement of a load must be optimized.

For purposes of illustration, it is assumed that the load traverses a path which lies in a two-dimensional plane. However, it is understood that the teachings of the present invention may be applied to movement of any load from a source location to a destination location via a path which may be in a single dimension or in more than two dimensions.

Referring now to FIG. 1, a crane control station 102 is illustrated schematically. The crane control station 102 includes a seat 104 in which the human operator may sit. AN anti-sway system 106 is illustrated as being close to the operator's seat in the crane control cab. The internal structure and operation of the anti-sway system will be described below, with special reference to FIGS. 3A, 3B and 5.

To the left of the operator's seat, a console 310 with a mode switch 110 is provided. The mode switch has three positions. The first position 112 places the anti-sway system 106 in the "LEARN" mode. A second position 114 turns the anti-sway system 106 off altogether (or places it in an "off" mode). Finally, a third position 116 places the anti-sway system 106 in the "AUTO" mode. Communication between switch 110 and the anti-sway system 106 is illustrated along a cable 126.

As will be described in greater detail below, the "LEARN" mode is chosen when the loading process is performed manually, but the anti-sway system 106 monitors the human operator's controls as well as the experienced trajectory of the load. When in the "AUTO" mode, the anti-sway system 106 controls the load movement process, with the operator simply watching until the movement is completed (or nearly completed) or if an emergency condition arises. The "OFF" mode is one in which the load movement process is manual, and the anti-sway system 106 does not monitor the operator's control movements.

An "AUTO" button 122 is provided on the console 310. In "AUTO mode", this button allows the operator to indicate he wants the anti-sway system 106 to take control of the load movement.

On the left and right sides of the operator's seat 104, joysticks 120L and 120R are provided. The joysticks provide control over the vertical and horizontal movement of the load. Signals indicative of the position of the joysticks are provided to the anti-sway system along paths 118 and 124, respectively.

Finally, connections 126, 128, 130 between the anti-sway system 106 and the console 310, indicators 132/134, and the existing crane drive system, respectively, are described below, with reference to the insertion of the anti-sway system into an existing crane.

It is understood that the arrangement in FIG. 1 is illustrative, and that variations thereof may be made in accordance with the principles of, for example, human factor engineering, and still remain within the scope of the present invention.

Figures 2, 4A, 4B:
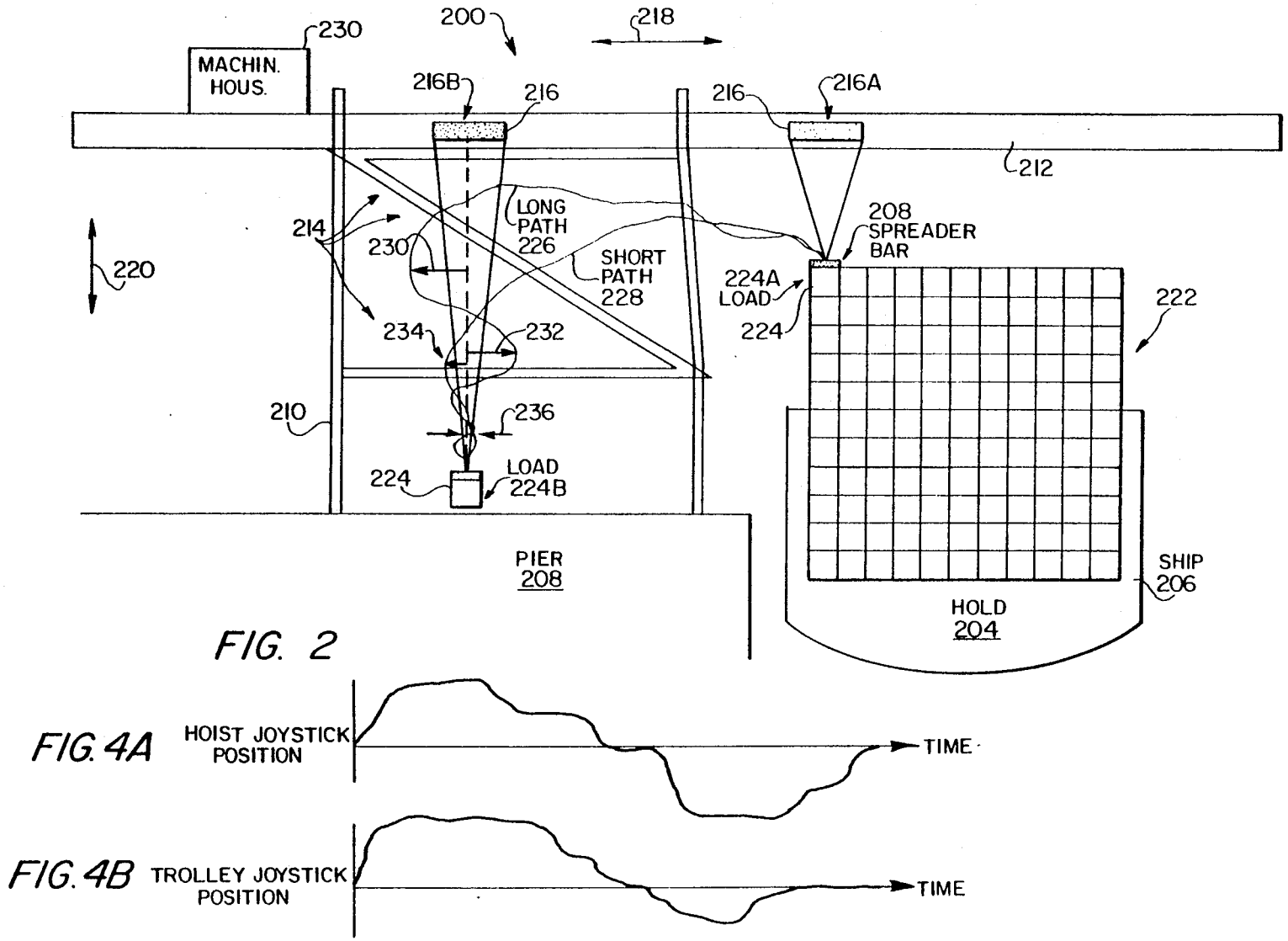
FIG. 2 is a schematic diagram illustrating the unloading of containers from the hold of a ship onto a pier.
FIGS. 4A and 4B illustrate typical joystick position signals as a function of time for the hoist joystick and the trolley joystick.

Referring now to FIG. 2, a crane 200 is illustrated. The crane 200 includes a vertical support post 210 and a horizontal traverse structure 212. A structure generally indicated as 214 provides additional stability to the crane.

Crane 200 is illustrated as a container crane, adapted to unload containers from the hold 204 of a ship 206 to a pier 208. The container crane 200 spans the limits of the container ship, and utilizes high-power speed-regulated motors normally located in a machinery house 230. The motors are indicated as elements 330, 336 in FIGS. 3A and 3B, discussed below. The motors are attached through wire ropes and other known mechanical means to a hoist and trolley mechanism. The hoist and trolley mechanism is adapted to move between a first location 216A to a second location 216B.

This hoist and trolley mechanism has at its terminus a spreader bar 202 which is adapted to attach mechanically to one of a group of containers 222 located in the hold of the ship. After attachment, a human operator (or the anti-sway system) in the control station 102 (FIG. 1) controls the motors in the machinery house 230 to move the hoist and trolley mechanism.

In the present specification, the hoist and trolley mechanism may be referred to as element 216, freeing it from limitation to a particular locations 216A, 216B. In this specification, "trolley position" denotes horizontal position along the horizontal traverse structure 212. Trolley position is indicated by bi-directional arrows 218. "Hoist position" denotes vertical position of the hoist mechanism, as indicated by bi-directional arrows 220.

For purposes of illustration, only trolley position and hoist position are discussed. However, the teachings of the present invention may be extended to three dimensions by extending the movement of the hoist and trolley mechanisms out of the plane of FIG. 2 by either orthogonal movement (perpendicular to both the trolley and hoist position lines 218, 220) or by rotating the crane about a central axis (such as vertical support post 210). Additional motor control hardware and position sensor hardware is added for each degree of freedom of the load.

A preferred application of the present invention is unloading a set of containers, generally indicated as 222, present within hold 204 of ship 206. A typical container (generically referenced as element 224) is illustrated in its "source" (initial) location 224A as well as near its destination position at 224B.

In operation, an inexperienced or fatigued operator may cause the load 224 to traverse a "long" path 226. It is readily apparent that long path 22 involves wasted time and possibly danger to individuals or cargo, as the load 224 sways from the vertical center line of the hoist and trolley mechanism. The sway is indicated by unidirectional arrows 230 and 232.

A more experienced operator would likely follow a more efficient path, such as "short" path 228. Short path 228 involves less sway than long path 226. The sway of short path 228 is indicated by unidirectional arrows 234 and 236, which are much shorter than corresponding sway arrows 230 232 for long path 226.

The experienced operator saves substantial time by causing the load to traverse short path 228. The time savings translates to substantial money savings when considering the many containers 222 present in the hold 204. Even a marginal improvement in the time efficiency of short path 228 over that of long path 226 provides tangible accumulated cost reduction in the unloading operation. Further, the experienced operator also reduces danger to cargo and personnel in the loading area by causing the load to traverse a path having less sway.

Thus, the experienced operator who minimizes the time necessary per discharge is able to unload the entire group of containers from the ship, and then load back another group of containers, with a substantial time savings relative to the inexperienced or impaired operator. This time savings is desirable for shipping lines and others involved in the loading and unloading of container ships.

Briefly, the present invention provides a means of remembering the experienced operator's control signals which caused the load 224 to traverse short path 228. In this manner, when the anti-sway system is later allowed to automatically control the movement of the load, an efficient path is followed, regardless of the level of experience or amount of fatigue of the operator. The inventive anti-sway system 106 (with accompanying external hardware for operation in the hoist and trolley scenario of FIG. 2) is illustrated in hardware block diagram form in FIGS. 3A and 3B (described below).

Installation of the anti-sway system into an existing crane may be accomplished as follows. Reference is made to FIGS. 1 and 2.

In the absence of the anti-sway system 106, the control sticks 120L, 120R (FIG. 1) would be directly connected through a system of wires (124, 118, and 130) from the operator's cabin to the hoist and trolley motor drives 332 and 338 in the machinery house 230. The magnitude of the control signal to the motor drive corresponds to the speed at which the motor drive will turn the motor to take up or let out wire rope to move the spreader bar with attached container.

Installation of the electronic anti-sway system 106 (FIG. 1) requires that the electrical connection between wire harnesses 118, 124 and harness 130 be broken and reconnected to the anti-sway system 106. The addition also requires the wiring of the mode switch 110 and AUTO button 122, and the audible and visual indicators 132 and 134, to the anti-sway system. Wire harnesses 126 and 128, respectively, are used for this task.

When the anti-sway system mode selector is in the OFF position 114, the operator controls the speed and direction of movement of the spreader. The operator uses the hoist and trolley control sticks as if the anti-sway system were not connected to the control system. The position of the hoist and trolley control sticks relative to the sticks' neutral position determines the speed and direction of the spreader's motion.

Figure 3A:
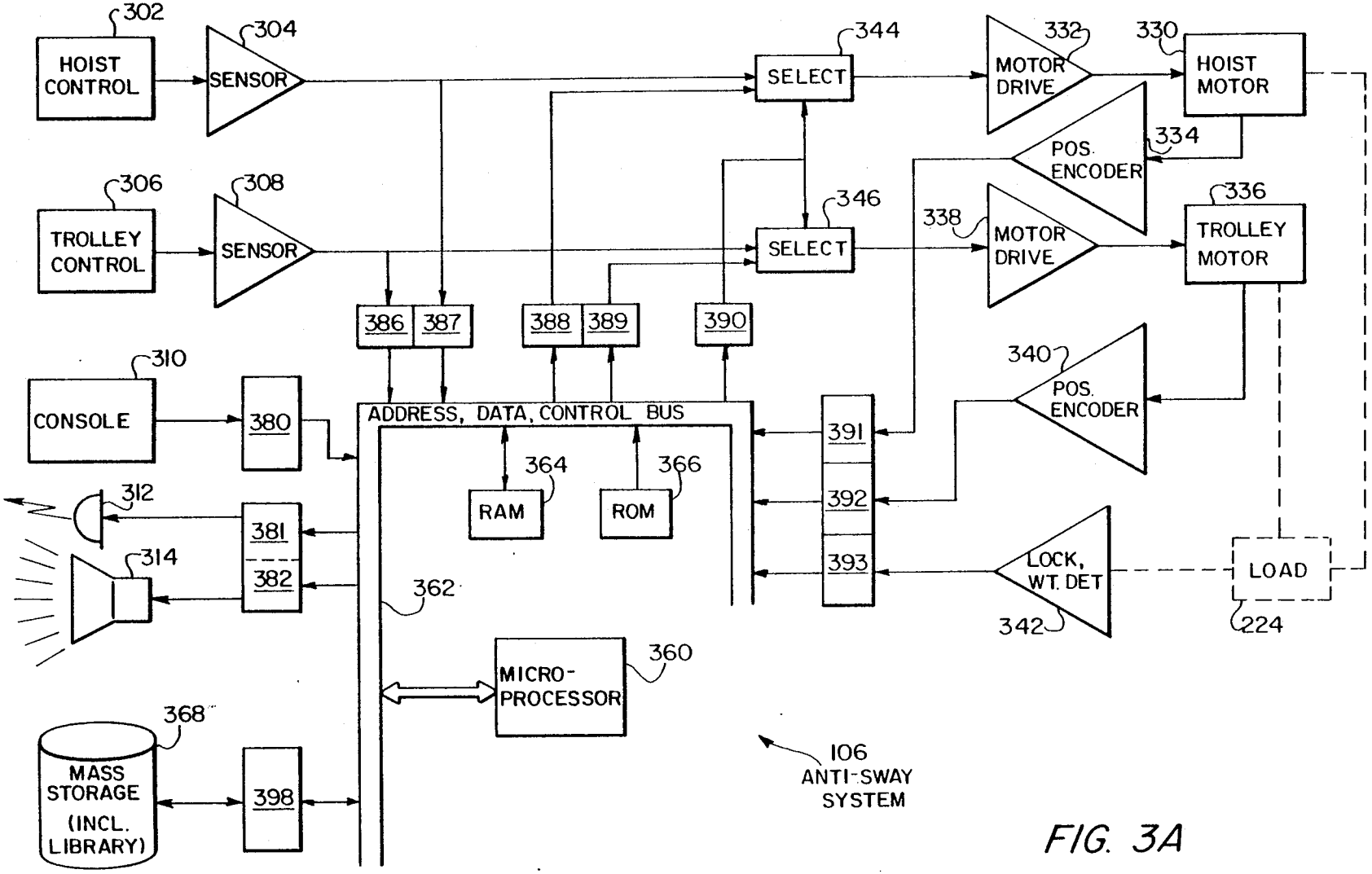
FIG. 3A is a functional block diagram illustrating the relationship of functional blocks in the inventive anti-sway system.

The interaction of functional elements in the inventive anti-sway system 106 (with accompanying external hardware for operation in the hoist and trolley scenario of FIG. 2) is illustrated in schematic form in FIG. 3A. Referring to FIG. 3A, hoist control 302 and trolley control 306 provide respective control signals to hoist control sensor 304 and trolley control sensor 308. The hoist and trolley controls 302, 306 are preferably implemented using two joysticks, such as joysticks 120L and 120R (FIG. 1). However, other implementations lie within the contemplation of the present invention.

Hoist and trolley control sensors 304, 308 sense the position of the hoist and trolley controls, respectively, and provide proportionate electrical signals to the anti-sway system 106. The electrical signals continuously indicate the sensed position of the hoist and trolley controls. A typical hoist control sensor signal output by hoist control sensor 304 is illustrated in FIG. 4A. Similarly, a typical trolley control sensor signal output by trolley control sensor 308 is illustrated in FIG. 4B. The signals shown in FIGS. 4A and 4B are preferably sampled at regular time intervals and the individual signal samples digitized for storage and processing in the anti-sway system 106.

A console 310 is also indicated in FIG. 3A. Console 310 is considered a generic indication of other control inputs, such as the mode switch 110, the AUTO button 122 (both in FIG. 1), or an optional "STOP" button (described below).

FIG. 3A illustrates various output devices, such as a visual indicator (or light) 312 and an audible indicator (or horn) 314. Such indicators are provided to alert the operator to status and/or emergency conditions detected by the anti-sway system 106.

Elements 304–314 are preferably located in the crane control station 102 (FIG. 1). Preferably, though not necessarily, they are physically close to the anti-sway system 106 to minimize data communications problems.

FIG. 3A also illustrates various components which are physically remote from the crane control station. The following elements are in physically associated with the hoist and trolley mechanism 216 (FIG. 2). Specifically, a hoist motor drive 332 controls the hoist motor 330. The position of the hoist is monitored by a hoist position encoder 334. Similarly, a trolley motor drive 338 controls trolley motor 336. A trolley position encoder 340 monitors the position of the trolley. Hoist position encoder 334 and trolley position encoder 340 provide respective outputs to the anti-sway system 106.

The weight of load 224 is measured by a weight measurement element 342. Further, element 342 determines whether the hoist and trolley mechanism is locked onto a load, sending a "lock" indication to the anti-sway system.

Hoist motor drive 332 and trolley motor drive 338 are controlled in the following manner. Hoist motor drive 332 and trolley motor drive 338 receive input signals from respective motor drive selectors 344, 346. The select input to selectors 344, 346 is generated by the anti-sway system and passes along a path 348.

Hoist motor drive selector 344 receives a first input from hoist control sensor 304, this hoist control signal for use during manual operation. Hoist motor drive selector 344 receives a second input from the anti-sway system when the hoist motor is under computer control.

Similarly, trolley motor drive selector 346 selects either the output from trolley sensor 308 or a computer-generated trolley motor drive signal from the anti-sway system 106, depending on whether manual or automated movement, respectively, is desired.

The anti-sway system 106 includes a conventional electronic digital computer. In a preferred embodiment, the computer includes a central processing unit (CPU) having a microprocessor 360 which is connected to address, data and control busses generally indicated as element 362. Other elements in suitable computer systems include a random access memory (RAM) 364 and read only memory (ROM) 366. RAM 364 may be used for temporary, fast-access functions which any internal memory capacity of microprocessor 360 may not allow. In the preferred embodiment, control sequences from hoist and trolley control sensors, positions from hoist and trolley position encoders 334, 340, and the weight and lock condition information from element 342, are all stored temporarily in RAM 364. ROM 366 may contain program coding or other preprogrammable information needed for operation of the system. Further, a mass storage device 368 (such as magnetic disk drive or magnetic tape drive or optical equivalents thereof) is also provided for storage of a library of desired paths and control signals. The particular arrangement and operation of elements 360–368 is neither particular nor crucial to the present invention, but may be chosen as any of a variety of computer systems readily available to and well understood by those skilled in the art.

Each of the elements which communicates with the anti-sway system's internal bus 362 is understood by those skilled in the art to generally require some form of interface. Such interfaces are illustrated in FIG. 3A in schematic form, their implementation being within the capability of those skilled in the art.

Specifically, a console interface 380 provides translation of signals from console 310. Similarly, indicator output interfaces 381, 382 translate signals to visual and audio warning devices 312, 314, respectively. It is understood that other indicators may include video screens, and driver cards for such video screens are readily available on the market. Input converters 386, 387 provide translation of the hoist and trolley control sensor signals generated by elements 304, 308. Output converters 388, 389, provide the hoist and trolley motor drive signals, respectively. Output converter 390 provides the manual/auto selection signal 348. Input converters 391, 392, translate encoded position signals of the hoist and trolley from encoders 334, 340. Input converter 393 translates the weight measurement and lock detection signals from element 342. Finally, a bi-directional interface 398 is provided between the bus 362 and mass storage device 368.

In a particular preferred embodiment (see FIG. 3B, below), the interface circuitry includes a four part analog SPST switch, with two normally closed switches and two normally open switches controlled individually. This arrangement allows the anti-sway system to determine which set of analog reference signals will be passed through to make up the hoist and trolley reference signals. After the determination is made, the output signals are current-amplified by respective operational amplifiers configured as unity gain buffers. The resulting signals are fed to the motor drives 332, 338 from the anti-sway system by way of wire harness 130.

Power for the interface circuitry is provided by a dual output AC to DC converter.

Digital output signals are buffered from the digital output card by means of several open collector transistor stages which provide a current path to COMMON for the motor drive or PLC (programmable logic controller) input card or relay coil (whatever is being used in the particular crane configuration).

It is understood that the hardware block diagram of FIG. 3A is schematic in nature, and that variations of the illustrated embodiment may be practiced while remaining within the scope of the present invention. For example, the hoist and trolley controls 302, 306 may be separate controls (as illustrated) or they may be an integrated control (such as in a single joystick). Similarly, if the crane includes more than a hoist and trolley arrangement (such as may be necessary in a three-dimensional embodiment) additional circuitry may be required to control the load's movement in three dimensions and to monitor its location in three-dimensional space. Extension of the above teachings to three dimensions lies within the contemplation of the present invention.

The physical location of the various elements may be chosen in accordance with known engineering principles. For example, it may be more economical or technically desirable to locate various interfaces remote from the anti-sway system 106. It may also be desirable to include more than one mass storage device 368, allocating different functions (such as the program storage or library functions) to different mass storage devices. Thus, FIG. 3A is but an illustrative embodiment to which the invention should not be limited.

The functional block diagram of FIG. 3A having been described above, FIG. 3B presents an implementation which is more closely representative of a actual embodiment. It is understood that like reference numerals refer to like elements or functions. Preferred implementations of individual elements are presented below, in Table I.

Figure 3B:
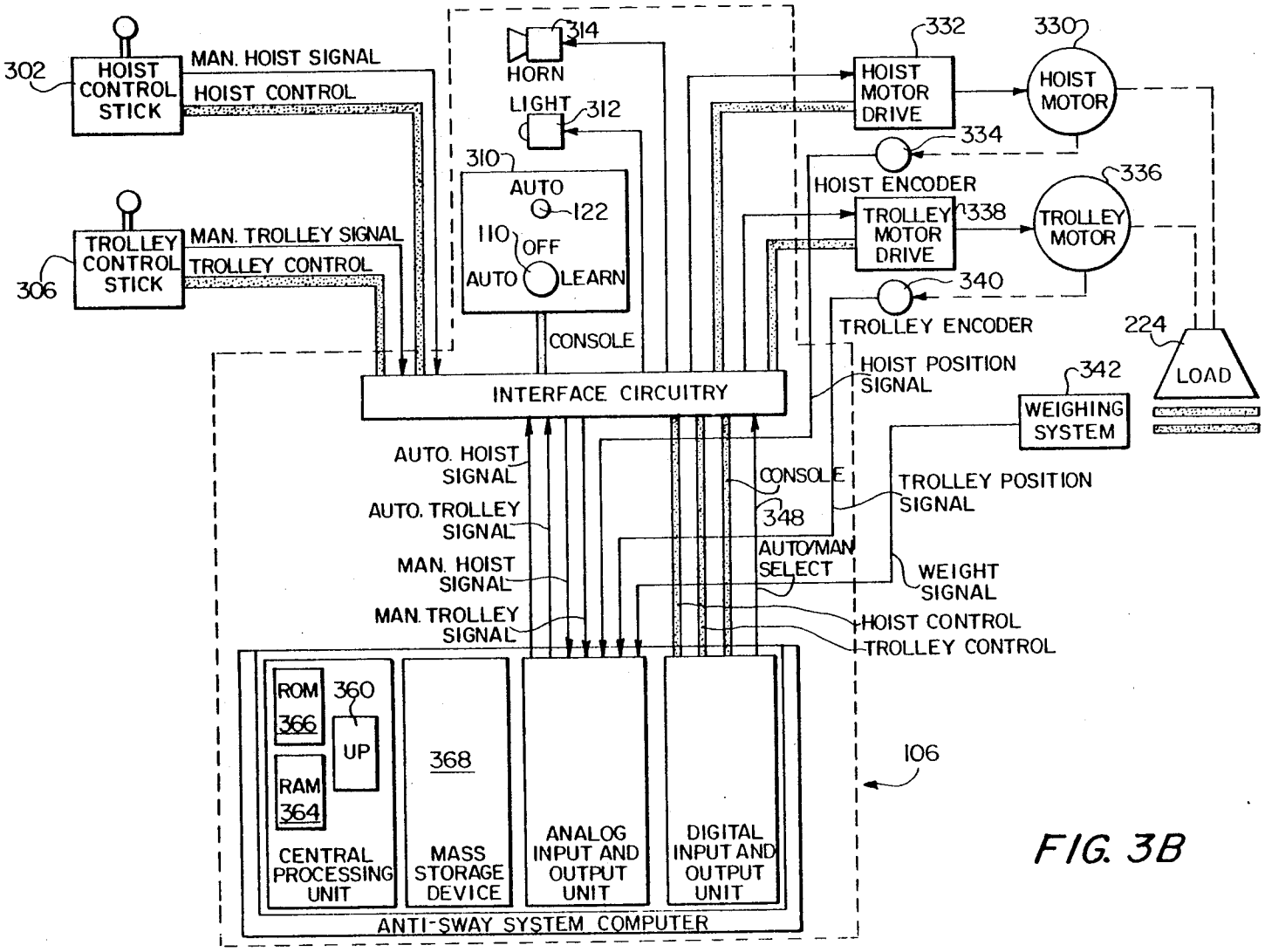
FIG. 3B is a hardware block diagram of the anti-sway system according to a preferred embodiment of the present invention.

Referring to FIG. 3B, the analog and digital control signals from the hoist and trolley control sticks are connected to the interface circuitry through wire harnesses 118 and 124 (FIG. 1). Signals for each control stick include the following:

(A) An analog voltage signal proportionate to the relative position of the stick with respect to its neutral center position (usually vertical).

(B) Three digital signals, usually in the form of dry contact closures, representative of the position of the stick. NEUTRAL contact closure corresponds to the stick at its center position. POSITIVE closure corresponds to the stick position in a positive direction with respect to the center position, and NEGATIVE closure corresponds to the stick in a position the opposite direction from the center position.

Digital (ON/OFF) signals are used to determine a "dead band" of the proportionate analog signal which should be construed as "zero" reference.

Interface circuitry passes these signals to the anti-sway system computer analog and digital input cards (FIG. 3B). If the state of the AUTO/MANUAL digital control line 348 from the anti-sway system is MANUAL, the manual control signals pass to the motor drives. If the AUTO/MAN SELECT line is in the AUTO state, the anti-sway computer reference signals from the analog output card are passed to the motor drives.

The control lines for audible and visual feedback, labeled HORN and LIGHT, carry digital signals which cause a tone or illumination of the attached devices 312, 314 depending upon the amount of time which the controlling lines are on.

Under program control described in greater detail below, the central processing unit coordinates the transfer of information and control to the analog and digital I/O cards from CPU RAM, ROM or MASS STORAGE.

The position encoders attached to the motor shafts are typically optical encoders which output a particular number of pulses for every revolution of the encoder shaft in a quadrature relationship which allows the attached circuitry to be able to determine the position differential with time and the direction of movement.

The weighing system consists of a load cell (strain gauge). With proper excitation the load cell outputs a low level voltage proportional to the amount of tension being placed on the hoist ropes which suspend the container load. This low level signal is conditioned and amplified and used, with the proper calibration, to determine the weight of the container.

Next, a brief overview of the operation of a preferred embodiment will be presented. Thereafter, a further explanation is presented, using the flow chart of FIG. 5.

Briefly, when the anti-sway system mode switch 110 (FIG. 1) is in the LEARN position 116, the system monitors the weight of the container load attached to the spreader, and the position of the container relative to some arbitrary location. The system waits for a condition in which the spreader suspends a container load over the ship. This "loaded condition" corresponds to the beginning of a discharge cycle of a container from the ship's hold to the pier. When a loaded condition is recognized, the anti-sway system "remembers" (stores) the weight of the container, and begins remembering the magnitude of the control signals from the hoist and trolley control sticks 120.

The sensed joystick control signals pass through wires 118 and 124 at an adjustable sampling rate. This sampling rate is adjustable based on secondary storage limitations, mechanical and electrical time constant considerations, and the limits of the analog signal input electronics attached to the anti-sway system.

In the LEARN mode, voltage signals proportional to the hoist and trolley position from encoders attached to the hoist and trolley wire take-up drums are also monitored by the anti-sway system through the wire harness 130 (FIG. 1) from the machinery house 230 (FIG. 2). These position signals are sampled with respect to time at the same rate as are the control signals mentioned above.

The anti-sway system automatically ends the remembering of the control and position signals when it senses that the spreader and container load have descended to a position below a safe height above the pier, or when the anti-sway system is turned to the OFF mode by the operator. In the latter case no more processing is done to the remembered information, and the information is intentionally discarded. In the former case, the remembered signals (specifically the sampled numbers representing the magnitudes of those signals with respect to time during the discharge operation), are formatted into a suitable file format, given a file name and file path according to a naming convention. This formatting and file naming uniquely identifies the weight range of the container and its trolley and hoist net travel lengths. The data file is saved to the storage device 368.

After the remembered information is properly formatted and saved, the LEARN CYCLE is considered complete. The anti-sway system reverts to monitoring the weight and position of the container load to begin another cycle.

When the anti-sway system mode selector is in the AUTO position 112, the system continually monitors the hoist and trolley position of the spreader and the container weight. When the system senses that there is a container load on the spreader (the weight signal is above a minimum threshold value) while the spreader is over the ship, the spreader position and container weight are used to identify a unique file path and file name corresponding to a previously saved set of control signals and position signals for a container of similar weight and similar starting position relative to the destination. If an exact match is found, the search ends and processing proceeds to control movement of the container.

If an exact match is not found, the system searches for relative starting positions within one foot, two feet (or some other progressively larger search limit) until a match is found or all possibilities are exhausted in that particular container weight range. If no exact or similar relative starting position match is found, the system reverts automatically to the LEARN MODE for that particular discharge sequence (to remember the discharge for future reference). The operator can opt to teach the system a discharge run or not by pressing the AUTO button for verification in response to a unique audible and visual indication from the horn and light.

If a match is found, the system indicates this fact to the operator with a unique audible and visual indication and waits for the hoist and trolley control sticks to be returned to a neutral position and the auto button 122 to be pressed. This indicates the operator wishes the anti-sway system to automatically move the container to the destination at a safe height above a truck lane on the pier. The system takes over control of the hoist and trolley reference signal lines in wire harness 130, and begins to play back the remembered hoist and trolley control signals from the data file. This results in the container load moving along a path very similar to the short path (FIG. 2) of the original container load.

During the entire container movement under AUTO control, the actual hoist and trolley positions with respect to time are compared to the remembered positions from the "matching" control signal file at a sampling rate equal to that originally used when remembering the hoist and trolley position signals to the data file. If the new positions ever differ from the old positions by more than a preset amount for longer than a preset time, the anti-sway system automatically indicates a position tracking error to the operator with a unique audible and visual sequence, and remands control of the hoist and trolley to the operator control sticks. The operator is then required to complete the movement of the container to its destination. The anti-sway system reverts back to the beginning of the AUTO cycle and waits for the next container load to be attached over the ship before it begins to search for a new set of data.

Figure 5:
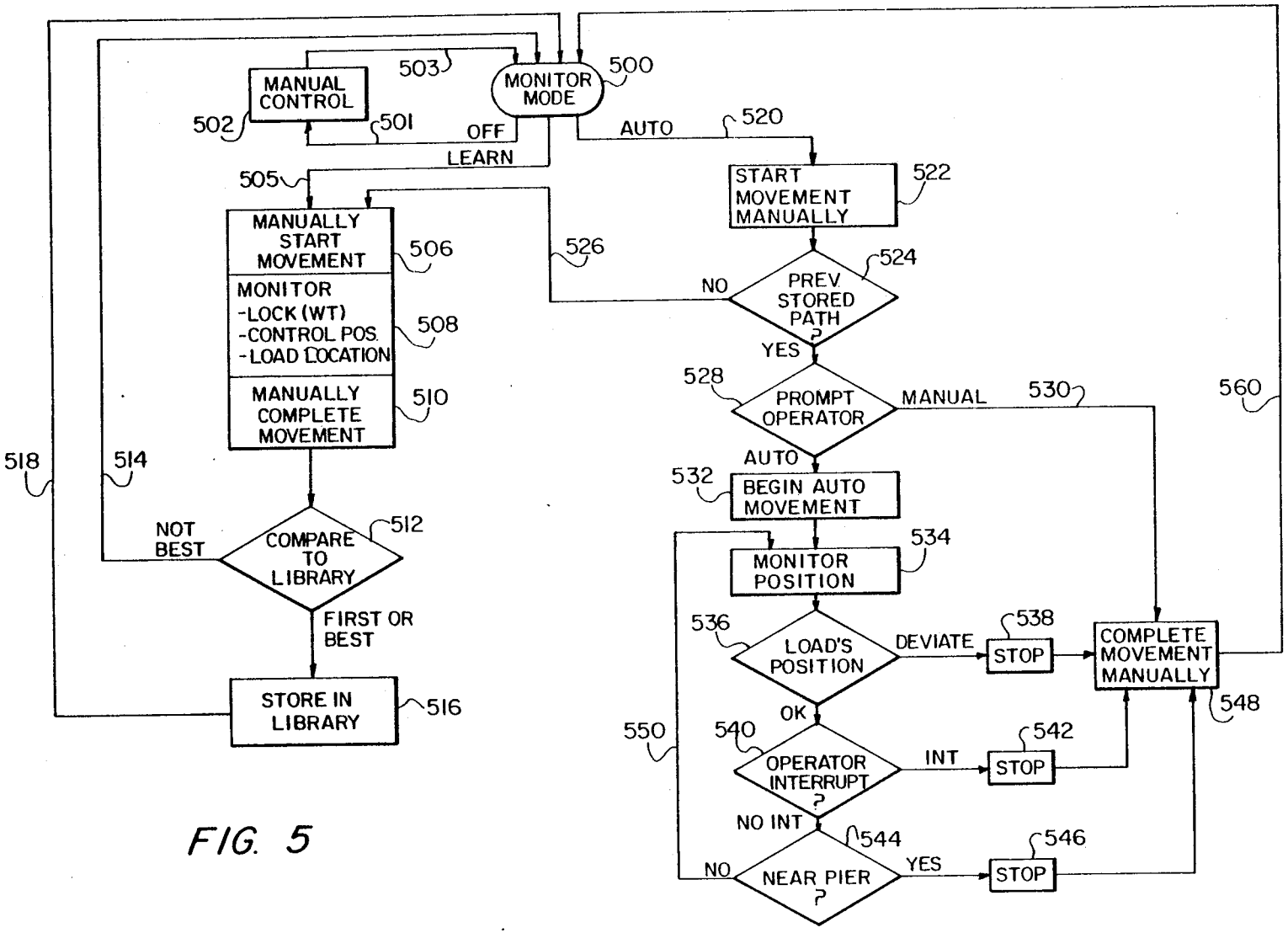
FIG. 5 is a flow chart indicating the operation of the anti-sway system according to the preferred embodiment.

The brief overview of the operation having been presented, a flow chart is presented in FIG. 5.

Referring now to FIG. 5, the operation of a preferred embodiment is illustrated in flow chart form. It is understood that the flow chart is but one illustration of the functions performed by a preferred embodiment, and that those skilled in the art may implement the functions in a variety of ways. Further, the fact that those skilled in the art may implement variations on the order in which the functions are performed, omit certain functions, and perform additional functions, lies within the contemplation of the invention.

At block 500, system control branches along one of three paths, depending on whether the system is off (or in "off" mode), in the "LEARN" mode, or in the "AUTO" mode. The mode is determined by the position of mode switch 110 (FIG. 1).

If the system is off ("off mode"), control passes along path 501 to block 502, which indicates that all control is manual. The anti-sway system neither monitors the operator's controls and load location, nor affirmatively controls the load movement. Control passe along path 503 back to monitoring block 500. It is understood that path 501, 502, 503 is schematic in nature, and that in many embodiments, the system may actually be completely powered off so that no processor is executing coded instructions.

If the mode switch is in the "LEARN" position, control passes along path 505 to block 506. At block 506, the human operator begins the movement of the load. During the movement process, various parameters are monitored by the anti-sway system, as indicated at block 508. In a preferred embodiment, the following parameters are measured.

First, the weight of the load, and whether or not the crane's grasping mechanism has locked onto the load (the "lock status"), are monitored. This monitoring and measurement are performed by element 342 (FIGS. 3A and 3B). The measured weight and the lock status are preferably stored in RAM 364 and in an internal register of microprocessor 360, respectively.

Also, the position of the operator's control mechanism is monitored, the position indicated by a proportionate electrical signal. In the illustrated embodiment, the hoist and trolley joystick signals (FIGS. 4A, 4B, respectively) from hoist and trolley controls 302, 306 (FIG. 3A) are sampled, digitized, and stored in the anti-sway system. These digitized control signals are preferably stored in RAM 364 (FIGS. 3A and 3B) of the anti-sway system.

Further, the spatial location of the load 224 is continuously monitored. Measurements of the load's location as a function of time are based on the outputs of position encoders 334, 340 (FIGS. 3A and 3B). Because the load in the illustrated embodiment traverses a planar path, a two-dimensional coordinate system adequately describes its location. Hoist position encoder 334 provides the vertical location of the hoist mechanism; and trolley position encoder 340 provides the horizontal position of the trolley. Together, the signals continuously output by the two position encoders 334, 340 define the load's path as a function of time. Paths such as short path 228 (FIG. 2) may thus be encoded as a series of "x,y" ordered pairs which indicate the position of load 224 as a function of time. The encoded path is preferably stored in RAM 364 of the anti-sway system.

Block 510 indicates the operator's completion of movement of the load.

Blocks 506, 508, and 510 are illustrated as contiguous so as to convey the fact that the monitoring of the lock status, control positions, and load location are continuously monitored throughout the operator's movement of the load. In a preferred embodiment, the hoist and trolley control signals and the hoist and trolley position encoders are sampled every 20 milliseconds. Similarly, the lock status is determined every 20 milliseconds. The weight of the load is determined as the average of the load signal at zero hoist acceleration, the average being taken over several load oscillation periods.

After the load's movement has been completed, the system ceases monitoring the control signals and load path. Completion of the movement may be determined by the lock status changing from "locked" to "unlocked", for example, or by the hoist height going below a minimum safe height. Control passes to decision block 512.

For purposes of describing a preferred embodiment, it is assumed that the digitized load path and control signals are stored in RAM 364 (FIGS. 3A and 3B). Decision block 512 performs a comparison of the digitized path of the present load to an appropriate path previously stored in a library in mass storage device 368. Here, a stored path is "appropriate" when the source location, destination location, and load weight match the present source location, destination location, and load weight within certain predetermined tolerances, as described above.

Briefly, the library is a data base including sets of associated control sequences (for example, FIGS. 4A, 4B), measured load paths (for example 228 in FIG. 2), and load weight. For a given source location, destination location, and load weight, only one path has previously been stored in the library. The path which is stored may be determined in a variety of ways. In accordance with a preferred embodiment, determination of the "best" path may be made by equally weighted considerations of:

(1) the minimum time from the start of the movement 506 until the completion of the movement 510, and (2) minimum sway of the load (indicated by arrows 234, 236 in FIG. 2).

The determination of the duration of the movement from 506 through 510 may be made by any suitable timing scheme, such as using the crystal-based clocks within commercially available desk top computers. Determination of the minimum amount of sway may be made, for example, by measuring the differential tension in hoist wires on the two sides of a spreader bar holding the load. Of course, other methods of determining the "best" path, such as different weighting of the above two factors, lies well within the contemplation of the present invention.

Control passes to block 516 if the present path stored in RAM 364 is determined to be the "best" path encountered for a given load weight and source/destination locations. The "best" present path is stored from RAM 364 into the library in mass storage device 368. Of course, if no appropriate path is present in the library (indicating this is the first time a particular set of source location, destination location, and load weight parameters has been encountered), control also passes to block 516.

In addition to the "best" path, the digitized control sequence (for example, FIGS. 4A, 4B), as well as the measured load weight, are also stored in the library. The path signals, control signals, and load weight are stored in association with each other, for later use in the AUTO mode.

After the best path 228 and corresponding control positions signals (such as those in FIGS. 4A, 4B) are stored in the library, control passes along path 518 to the mode monitor block 500.

If the present path stored in RAM 364 is determined not to be the best path, control passes along path 514 to mode monitor block 500. This demonstrates how, in the preferred embodiment, only the best path is stored in the library.

Through multiple iterations of the "LEARN" mode loop 505-514/518, a library of stored sets of control sequences, load paths, and load weights is accumulated. In the scenario of unloading a ship's containerized cargo onto a pier, different sets are stored as the operator unloads many containers from a ship, and as he unloads containers from several ships in sequence. Any variation beyond given tolerances of source location, destination location, or load weight causes a different set to be stored in the library. Thus, unloading several ships may be advantageous in compiling a library which has optimized operator control sequences. Optimization of operator control sequences may be achieved through comparison of consecutive iterations of load movements in which the source location, destination location, and load weight are the same, to within given tolerances.

This complete discussion of the "LEARN" mode.

If the system is in "AUTO" mode, control passes from mode monitor 500 along path 520 to block 522. At this time, the system is neither monitoring the operator's control signals nor controlling the position of the load.

At block 522, the operator manually starts movement of the load. At this time, it is determined that a spreader bar has locked onto the load, and the weight of the load is measured. These parameters are determined by element 342 (FIGS. 3A and 3B). Further, at this time, the source location of the load is determined, based on the present position sent to the anti-sway system by hoist and trolley position encoders 334, 340, respectively.

The destination location is determined by any number of methods. For example, in many applications, there may be assumed to be a limited number of possible destination locations, the number limited by the width of the pier, for example. A sequence of these predetermined positions may be pre-programmed into files accessible to the software illustrated in FIG. 5, and accessed at the time of execution.

The source and destination locations may be determined either "absolutely" (with reference to an arbitrary stationary position, such as a zero position of the hoist and trolley mechanisms, or "relatively" (the destination location relative to the source location). The latter approach has the advantage that the fewer entries need be made in the library, and each entry may be more optimized because the result of a potentially greater number of learned control sequences.

In any event, as control passes from block 522 to decision block 524, the weight of the present load, as well as the present source and destination locations, are known.

At decision block 524, the library in mass storage device 368 (FIGS. 3A and 3B) is searched for a group of associated data (hereinafter called a "set") denoting similar load weight, source location, and destination location. Conceptually, this library search determines whether an "appropriate" sequence of operator control signals (such as in FIGS. 4A, 4B) has previously been stored for efficiently moving the present load from its present source location to its desired destination location. The "appropriateness" (as used herein) of sets of parameters in the library is determined when the source location, destination location, and load weight match the present source location, destination location, and load weight lie within predetermined tolerances of the corresponding present set of parameters.

If an appropriate set has not previously been stored in the library, control passes along path 526 to block 506, indicating that control passes automatically into the LEARN mode. This path 526 indicates the operator's manual completion of the load's movement, without system intervention. The system's monitoring of the operator's manual load movement can be suppressed by, for example, by not pressing the AUTO button in response to an audible or visual signal generated by the system.

However, if the present load weight, and the present source and destination locations, match those stored in the library to within a given tolerance, control passes to decision block 528. The system causes a visual and/or audible indication to be given to the operator that a suitable stored control sequence is present in the computer's library. The operator may then choose to allow the computer to take over control of the load's movement, or to retain control of the movement himself. The operator may indicate this choice to the system by use of the "AUTO" button 122 (FIG. 1).

If the operator chooses not to allow the computer to control the load's movement, he refrains from pushing the "AUTO" button 122 (or provides some alternative indication by an optional "MANUAL" button provided in some embodiments). Control passes along path 530 to allow the operator manually complete the load's movement himself, indicated at block 548.

Conversely, if the operator chooses to allow the anti-sway system to control the load's movement, control passes from decision block 528 to block 532. At block 532, the anti-sway system begins automated movement of the load. Thereafter, the position of the load is continuously monitored to assure the load does not deviate from the path chosen from the library.

MONITOR LOAD POSITION block 534 is illustrated as part of a software loop 534, 536, 540, 544, 550 to show the repetitive monitoring of the position of the present load in its trajectory, as a function of time. During each iteration of the loop, present samples from each of the position encoders 334, 340 are compared to a corresponding sequence of stored location values in the library. Successive iterations of the loop process data corresponding to successive sampling times.

The stored location values constitute a predicted optimum path which the present load should follow. The stored path may be considered a predicted optimum path because the source location, destination location, and load weight are the factors substantially affecting the path which the load actually follows under control of the crane. Because the crane is controlled by stored control signals which were associated with the stored load path and a stored load weight, and because these parameters are substantially the same as the present parameters, the present load should follow substantially the same path a that followed by earlier load during the "LEARN" mode. Only extraneous factors (such as equipment malfunction, collision, or inconsistent reaction of motor drives to control signals) should cause deviation of the load from its predicted optimum path.

The comparison of the present load path to the stored predicted optimum path is indicated as being a part of decision block 536. If the present position values are within a given predetermined tolerance of corresponding library values for that sampling time, control passes to decision block 540.

However, if the measured location value and the stored location value differ by more than a predetermined threshold, control passes to block 538, in which the motion of the hoist and trolley mechanism 216 is stopped. In this instance, equipment malfunction or an unwanted collision may have occurred, or the motor drives may be responding differently to the motor drive signals than they did during the "LEARN" mode. Thus, it is an advantageous safety feature of the present invention that the system immediately surrenders control of the load when a deviation from the ideal path is detected. Thereafter, the operator must manually complete the movement, as indicated at block 548. In an alternative embodiment (not specifically illustrated in FIG. 5) control may pass to block 506, indicating entry into the LEARN mode to allow the operator's completion of the load movement to be monitored and considered for storage in the library.

Assuming that the present position matches the predicted position (as stored in the library), control passes to block 540. Decision block 540 schematically illustrates the capability of a preferred embodiment to allow the operator to instantly take control of the loading process. This is illustrated as an interrupt, as commonly known to those skilled in the programming art. Such an interrupt may be implemented by any change in the position of the hoist or trolley control joysticks, which causes an interrupt of microprocessor 360 in a manner well known to those skilled in the computer hardware and firmware arts. When an interrupt is encountered, control passes from decision block 540 to block 542, indicating that the load is stopped. Thereafter, the operator may manually complete movement of the load, as indicated at block 548.

FIG. 5's illustration also encompasses the implementation in which the CPU may execute a polling routine, interrogating inputs from, for example, console 310 (FIGS. 3A and 3B). In a further embodiment, for example, a "STOP" button (which may be considered a "panic button") may be present on the console 310 which allows the operator to instantly stop the motion of the load, such as when he views a dangerous situation developing which the position monitoring routine at blocks 534/536 could not detect in time to prevent damage or injury.

Assuming the user has not interrupted the automated loading process by moving the joystick(s) or pressing the "STOP" button control passes to decision block 544. Decision block 544 illustrates a feature of a preferred embodiment which allows the load to be automatically stopped as it approaches the destination location (or, incidentally, any other location which is deemed dangerous). In the embodiment illustrated in FIG. 2, the load is stopped above the pier 208, largely as a safety measure to prevent the load from striking people on the pier during automated motion. Decision block 544 indicates the comparison of the present location of the load (as determined by position encoders 334, 340) to an absolute location defined with reference to pier 208. If the load is determined to have crossed a threshold approaching the pier, control passes to block 546, in which the movement of the load is stopped. Thereafter, the human operator is entrusted to complete the movement of the load as indicated at block 548.

However, if the load has not closely approached the destination location (pier) control passes along feedback path 550 to MONITOR POSITION block 534. The position of the load is then monitored in the next iteration of the loop bounded by blocks 534 and 550.

Any of blocks 524, 528, 536/538, 540/542, 544/546 may involve branching either to the LEARN mode block or to the manual completion block 548, depending on designer preference. This designer preference determines whether the operator's completion of the load movement is monitored for possible inclusion in the library.

The structure and operation of various embodiments have been described above, with the understanding that significant variations of both hardware elements and interconnections, software functions and ordering thereof, may be made while still remaining within the contemplation of the invention. Further, the various elements shown in the drawing figures may be implemented by those skilled in the art, based on the descriptions found in the present specification. However, for still further understanding of the invention, a preferred embodiment may be implemented using the following illustrative, non-limiting examples of components.

TABLE I

| Element | Implementation |
|---|---|
| Crane 200 | KONE single hoist container crane, S/N 9428 |
| Crane control | GENERAL ELECTRIC Model 6000 Series Six PLC |
| Computer 360-366 | ZIATECH ZT-8910 386SX/20 Industrial Board Computer with STD bus; VERSALOGIC VL-1225 Analog Input/Output Card; ZIATECH ZT-8845 General Purpose digital I/0 Board; VERSALOGIC VS-SERIES STD 12 slot rack |
| Control sensors 304, 308 | VERSALOGIC analog board. STD |
| Hoist motor drive 332 | GENERAL ELECTRIC DC300 |
| Hoist position encoder 334 | BEI |
| Trolley motor drive 338 | GENERAL ELECTRIC DC300 |
| Trolley position encoder 340 | BEI |

TABLE I-continued

| Element | Implementation |
|---|---|
| Weight meas/lock detect 342 | NOBEL ELECTRONICS, INC. shear pin type; BLH ELECTRONICS, INC. amplifier; GENERAL ELECTRIC analog input |
| Selectors 344, 346 | LM13333 |
| Mass storage device 368 | 40 MB CONNERS 3½" hard drive |

In the same manner that the listed hardware is exemplary and non-limiting, the flow chart of FIG. 5 may be implemented using any programming language appropriate to the computer hardware employed in FIGS. 3A and 3B. In a preferred embodiment, the C or C++ languages are preferably used to code the functions illustrated in FIG. 5. The firmware for the various interfaces in FIGS. 3A, 3B are resident within the commercially available products listed above, and need not be further described.

The above listing of implementations of hardware, software, and firmware, and the particular interconnection and interaction thereof, are exemplary and illustrative, and do not limit the scope of the present invention. More generally, modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

What is claimed is:

1. An apparatus for moving a load from a source location to a destination location, the apparatus comprising:

a) a control device by which an operator may control movement of the load, the control device providing control signals;

b) a drive device for moving the load;

c) a position detection device for detecting the position of the load, the position detection device providing position signals;

d) a system, responsive to the control device and position detection device, the system being:

1) operable in a first mode to determine a preferred path for the load from its source location to its destination location, and for storing the control signals and the position signals related to the preferred path in a library, wherein the drive device is responsive to the control signals; and 2) operable in a second mode to control movement of the load in response to previously-stored control signals related to a preferred path, wherein the drive device is responsive to the previously-stored control signals.

2. The apparatus of claim 1, wherein:

the apparatus is a crane adapted to move cargo containers between a ship and a loading dock, the cargo containers constituting loads.

3. The apparatus of claim 1, wherein the control device includes:

a device for proportionally translating the operator's manual motion into a signal for use by the system.

4. The apparatus of claim 1, wherein the system includes a digital computer.

5. The apparatus of claim 4, wherein:

the digital computer includes a microprocessor.

6. The apparatus of claim 1, wherein the system includes:

means, active in the first mode, for storing present control signals and present position signals only when path criteria are better met by the present position signals than any previously stored sets of stored control signals and position signals.

7. The apparatus of claim 6, wherein:

the path criteria include (1) a time required to move the load from the source location to the destination location, and (2) a physical parameter related to motion of the load.

8. The apparatus of claim 7, wherein:

the physical perimeter includes a measurement of the load's swaying motion, so that those control signals and present position signals are stored which tend to reduce the amount by which the load sways during its movement.

9. The apparatus of claim 8, wherein:

the path criteria further include source location data, destination location data, and data relating to obstacles near possible paths of the loads, so that control signals and position signals relating to different source locations and destination locations are separately stored, allowing the apparatus to control movement of the loads in the second mode in a variety of paths.

10. The apparatus of claim 1, wherein the second mode further includes:

means for comparing an actual path to the previously stored path and halting the load when the actual path deviates form the previously stored path by more than a predetermined threshold.

11. The apparatus of claim 1, wherein the system further includes a third mode in which:

the operator initially moves the load from the source location in accordance with the control signals before the second mode is entered, while the system does not analyze the control signals and the position signals; and the operator completes the motion of the load after the system exits the second mode.

12. An apparatus for moving an object from a source location to a destination location, the apparatus comprising:

a) a control device by which an operator may control movement of the object, the control device providing control signals;

b) a position detection device for detecting the position of the object, the position detection device providing position signals;

c) a computer, responsive to the control device and position detection device, the computer including:

1) a first set of computer instructions to allow the control signals from the control device to control movement of the object from the source location to the destination location, the first set of computer instructions also analyzing the control signals and the position signals and determining whether they should be catalogued;

2) a storage medium for storing the control signals and position signals which the first set of computer instructions determines should be catalogued; and 3) a second set of computer instructions, responsive to an operator's choice of a source location and destination location, to allow control signals previously catalogued in the storage medium to automatically control movement of the object from the source location to the destination location; and d) a drive device for physically moving the object in accordance with either (i) the control signals from the control device, or (ii) the control signals previously catalogued in the storage medium.

13. The apparatus of claim 12, further comprising:

a third set of computer instructions for comparing to a threshold value a difference between (i) the position signals from the position detection device and (ii) the position signals previously catalogued, and preventing previously-catalogued control signals from controlling movement of the object when the difference exceeds the threshold value.

14. The apparatus of claim 12, wherein the computer includes:

means, active in the first mode, for storing present control signals and present position signals only when path criteria are better met by the present position signals than any previously stored sets of stored control signals and position signals.

15. The apparatus of claim 14, wherein:

the path criteria include (1) a time required to move the object from the source location to the destination location, and (2) a physical parameter related to motion of the object.

16. The apparatus of claim 15, wherein:

the physical perimeter includes a measurement of the object's swaying motion, so that those control signals and present position signals are stored which tend to reduce the amount by which the object sways during its movement.

17. The apparatus of claim 16, wherein:

the path criteria further include source location data, destination location data, and data relating to obstacles near possible paths of the objects so that control signals and position signals relating to different source locations and destination locations are separately stored, allowing the apparatus to control movement of the object in the second mode in a variety of paths.

* * * * *